US009863145B2

(12) United States Patent
Genest et al.

(10) Patent No.: US 9,863,145 B2
(45) Date of Patent: Jan. 9, 2018

(54) MASONRY BLOCK SYSTEM

(71) Applicants: Christopher Genest, Stanford, ME (US); Matthew Genest, Stanford, ME (US)

(72) Inventors: Christopher Genest, Stanford, ME (US); Matthew Genest, Stanford, ME (US)

( * ) Notice: Subject to any disclaimer, the term of this patent is extended or adjusted under 35 U.S.C. 154(b) by 0 days.

(21) Appl. No.: 15/307,563

(22) PCT Filed: Apr. 27, 2016

(86) PCT No.: PCT/US2016/029508
§ 371 (c)(1),
(2) Date: Oct. 28, 2016

(87) PCT Pub. No.: WO2016/176297
PCT Pub. Date: Nov. 3, 2016

(65) Prior Publication Data

US 2017/0145690 A1 May 25, 2017

Related U.S. Application Data

(60) Provisional application No. 62/154,280, filed on Apr. 29, 2015.

(51) Int. Cl.

| | |
|---|---|
| ***E04B 2/18*** | (2006.01) |
| ***E04C 1/39*** | (2006.01) |
| ***E04B 2/46*** | (2006.01) |
| ***E04B 2/52*** | (2006.01) |
| *E04B 2/02* | (2006.01) |

(52) U.S. Cl.
CPC ..... *E04C 1/39* (2013.01); *E04B 2/46* (2013.01); *E04B 2/52* (2013.01); *E04C 1/397* (2013.01); *E04B 2002/023* (2013.01); *E04B 2002/0293* (2013.01)

(58) Field of Classification Search
CPC ..... E04B 2/18; E04B 2002/0206; E04B 2002/0226; E04B 2/52; E04B 2/46; E04C 1/41
See application file for complete search history.

(56) References Cited

U.S. PATENT DOCUMENTS 1,652,305 A * 12/1927 Frewen ..... E04B 2/14 52/436
3,936,987 A * 2/1976 Calvin ..... E04B 2/08 52/309.1

(Continued)

FOREIGN PATENT DOCUMENTS

| | | |
|---|---|---|
| EP | 1505217 | 2/2005 |
| WO | 2013-043697 | 3/2013 |

*Primary Examiner* — Rodney Mintz
*Assistant Examiner* — Daniel J Kenny
(74) *Attorney, Agent, or Firm* — Jeffrey Joyce; Patricia Mathers

(57) ABSTRACT

A masonry block having chambers and cavities that form recesses in the block such that, when the blocks are laid on bond, re-bar may be inserted in horizontal and vertical directions for rectangular grid reinforcement, and the wall may be constructed without the use of mortar. The masonry block includes a stretcher block, end block, and a half-block and each block block has recesses for receiving insulation, re-bar, and/or a line pin.

8 Claims, 11 Drawing Sheets

(56) References Cited

U.S. PATENT DOCUMENTS

| | | | | | |
|---|---|---|---|---|---|
| 3,968,615 | A * | 7/1976 | Ivany | E04B 2/8629 | 52/259 |
| 4,148,166 | A * | 4/1979 | Toone | E04B 2/44 | 52/270 |
| 4,319,440 | A * | 3/1982 | Rassias | E04B 2/52 | 52/438 |
| 4,527,373 | A * | 7/1985 | Cruise | B28B 11/042 | 52/405.1 |
| 4,565,043 | A * | 1/1986 | Mazzarese | E04B 2/26 | 52/592.6 |
| 4,640,071 | A * | 2/1987 | Haener | E04B 2/46 | 52/100 |
| 5,822,939 | A * | 10/1998 | Haener | E04C 1/41 | 52/286 |
| 6,799,405 | B2 * | 10/2004 | Gilbert | E04B 2/46 | 52/592.6 |
| 7,305,803 | B2 * | 12/2007 | Correa | E04B 2/16 | 52/503 |
| 8,596,014 | B2 * | 12/2013 | Genest | E04C 1/00 | 52/600 |
| 2003/0002925 | A1 | 1/2003 | Blomquist et al. | | |
| 2013/0074436 | A1 | 3/2013 | Bott | | |
| 2013/0276400 | A1 | 10/2013 | Genest et al. | | |

* cited by examiner

MASONRY BLOCK SYSTEM

BACKGROUND INFORMATION

Field of the Invention

The invention relates to a masonry block. More particularly, the invention relates to a building block having cavities for insulation.

Discussion of the Prior Art

Masonry blocks are frequently used for building walls of residential and commercial structures. In a conventional masonry block wall, the blocks are laid on bond, that is, the one block covers one half of two blocks below it, so that the vertical joint formed by adjacent blocks in one row does not align with a vertical joint similarly formed in a previous row. The blocks typically have passageways that allow reinforcement bars (hereinafter referred to as "re-bar") to be inserted through the blocks to form a rectangular grid. For example, every four feet in the horizontal direction a re-bar is inserted in the vertical direction through the rows of block in that vertical four-foot length, and every four feet in the vertical direction a re-bar is inserted in the horizontal direction through the blocks that form that four-foot expanse. The re-bar is then tied together to form a rigid grid by filling cement grout into the cavities with the re-bar.

It is highly desirable these days to provide a masonry block that contains insulation material. The fact that re-bar is inserted in masonry blocks makes it difficult to easily and economically provide a masonry block with insulation. It is also difficult to secure the insulation within the block.

BRIEF SUMMARY OF THE INVENTION

The masonry block according to the invention, which includes a stretcher block, an end block, a corner block, a half block, and a corner block, has chambers or cavities for receiving insulation and re-bar. The layout of the chambers and recesses in the masonry block is such that, when the blocks are laid on bond, the re-bar may be inserted in the horizontal and vertical directions for rectangular grid reinforcement. Additional chambers with small notches are provided in the block for receiving and securing insulation material. Small notches for line pins are also provided in front and rear faces of the blocks. These blocks are used to construct a wall without the use of mortar and, when a course of blocks is put in place, conventional line pins may be inserted in these notches and a line inserted through the pins and pulled taut, thereby ensuring that the block formation is straight. A narrow chamber on the front face of the block allows electrical cables to be placed within the wall such that an electrical box may be placed flush against the wall. A wall constructed with this masonry block thus has greater strength and rigidity than a conventional masonry block wall and a greater insulation value. The wall construction is less expensive than conventional construction and has a positive environmental impact, because of a reduced amount of energy that is required to heat or cool a building constructed with the masonry block according to the invention.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1B:
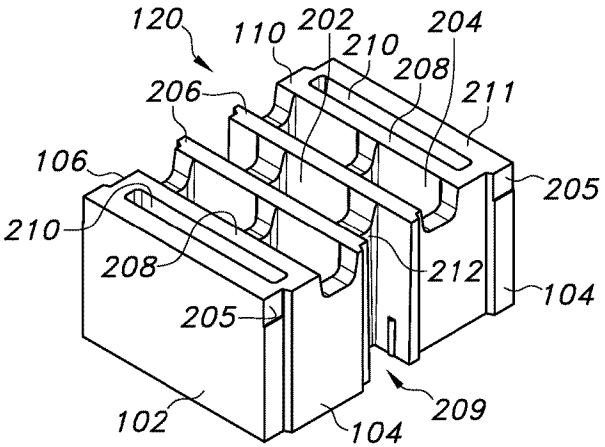
FIG. 1B is a second perspective view of the stretcher block, showing the second end face and the second wall face.
Figure 1A:
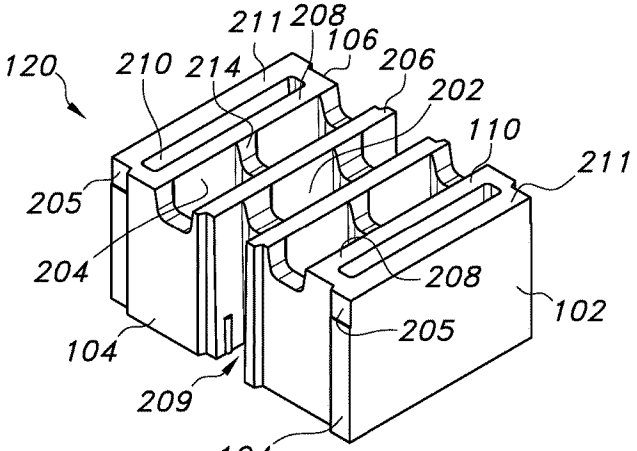
FIG. 1A is a first perspective view of a stretcher block, showing the top face, the first wall face, and the first end face.
Figure 1D:
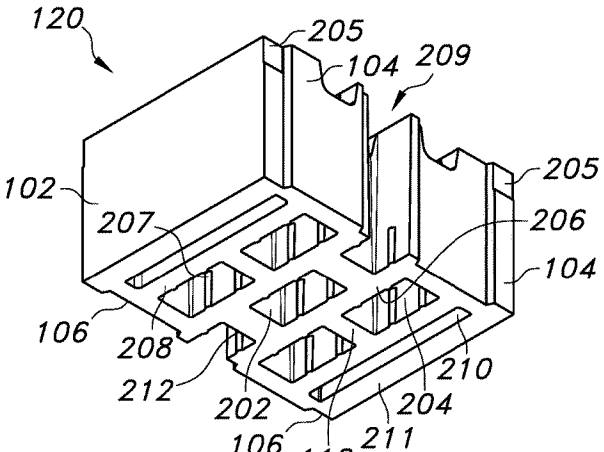
FIG. 1D is a fourth perspective view of the stretcher block, showing the second wall face.
Figure 1C:
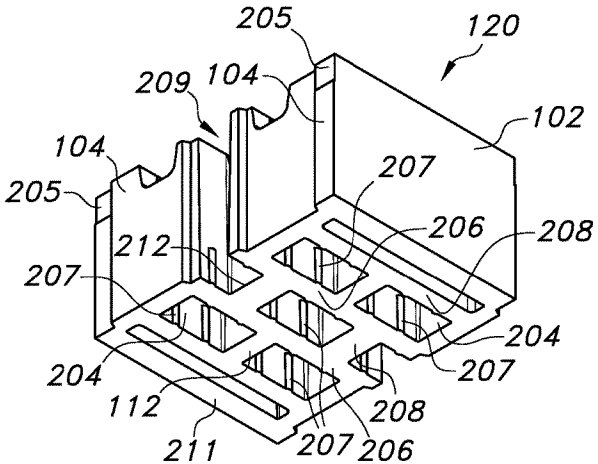
FIG. 1C is a third perspective view of the stretcher block, showing the bottom face and first wall face.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

The invention is a masonry block 100 for building masonry block walls. The masonry block 100 is constructed to receive insulation material. The insulation material may be in any suitable form, for example, a rigid foam block, batting, or spray foam insulation.

The term "masonry block 100" is a general term for the block according to the invention and includes a stretcher block 120, a half block 140, an end block 160, a corner block 180, and a spacer block 190. Incorporated into each block 100 are one or more chambers or recesses 200 for receiving insulation among other things, as well as a connector means 300 for mating adjacent blocks with each other. The general shape of the blocks 100 is rectangular, whereby the generally rectangular outer perimeter has one or more indentations, protrusions, and/or cavities on one or more of the faces of the particular block. Each block has two wall faces 102 that form opposite sides of the block and are the faces of the block that are visible on the two faces of a wall, and each block has a first end face 104 and a second end face 106, a top face 110, and a bottom face 112. Elements that are functionally identical in the various blocks 120, 140, 160, 180, and 190 retain the same reference designation.

Figure 1E:
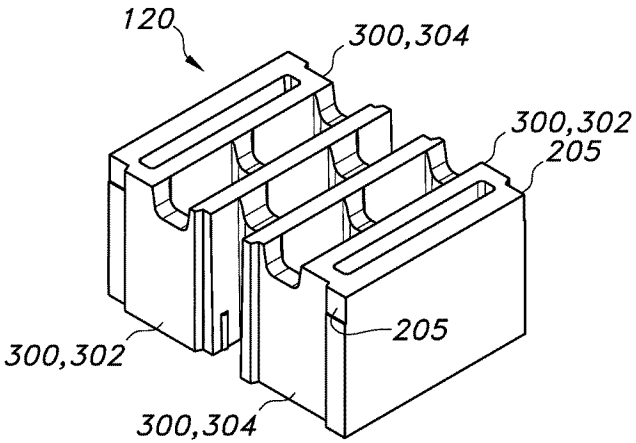
FIG. 1E is a fifth perspective view of the stretcher block, showing the second end face and the second wall face.
Figure 1F:
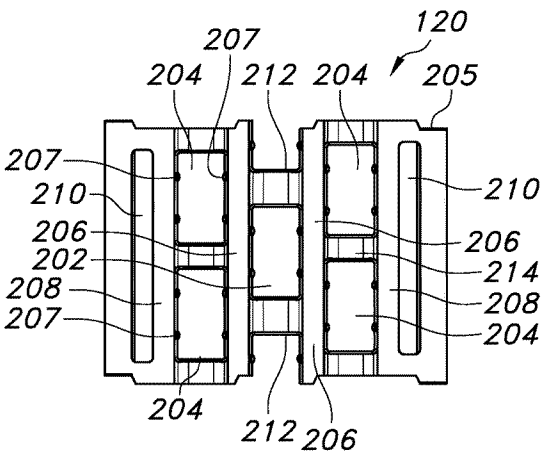
FIG. 1F is a planar view of the top face of the stretcher block.
Figure 1H:
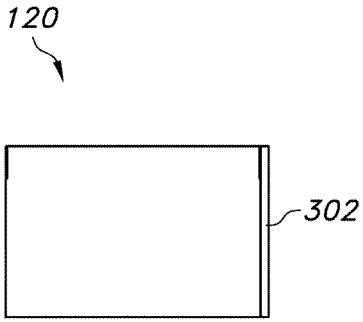
FIG. 1H is a planar view of the wall face of the stretcher block.
Figure 1G:
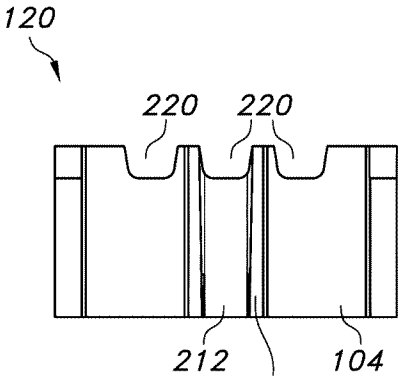
FIG. 1G is a planar view of the second end face of the stretcher block with female connector.

FIGS. 1A-1H illustrate the stretcher block 120, whereby FIGS. 1A-1E are perspective views that show all six faces and FIGS. 1F-1H planar views of various faces of the block 120. The wall faces 102 are mirror-reverse images of each other and, thus, one reference designation shall be used to indicate one or both of the wall faces. The connector means 300 on the stretcher block includes a male connector 302 and female connector 304, as shown in FIG. 1E, on each end face 104, 106. When two stretcher blocks 120 are assembled adjacent to one another on a row, the male connector 302 on the first end face 104 mates with the female connector 304 on the second end face 106 of the adjacent block.

The FIGS. 1A-1G show a plurality of chambers, recesses and cavities 200. One center chamber 202 is provided in the center portion of the block 120, that portion that is between the bounds of the male and female connectors 302, 304, on the end faces 104, 106, respectively. Four inner chambers 204 are provided, two on either side of the center chamber 202 and positioned within the bounds defined by the male and female connectors 302, 304 on the end faces 104, 106 respectively. Center webs 206 separate the center chamber 202 from the inner chambers 204. An intermediate web 208 separates the inner chambers 204 from outer chambers 210, which are bounded by an outer web 211. The center chamber 202 is bounded on the ends by a cavity wall 212. The inner chambers 204 are separated from one another by inner chamber walls 214 and bounded on the ends by the cavity walls 212. The outer chambers 210 are bounded on the ends by end faces 104, 106. The cavity walls 212 also form outer recesses 220. When the stretcher block 120 is placed adjacent to any of the other types of blocks 100, each block 100 will have an outer recess that aligns with the outer recess 220 of the stretcher block 120. The chambers 202, 204 and 210 and the recesses 220 are open passages that extend through the stretcher block 120. Small notches 205 are provided in the upper corner of each face 104, 106 of the block 100, which allow for the insertion of line pins (not shown). After a course of blocks 100 has been put in place, a line may be run through the line pins which, when drawn tight, will force the blocks into a straight alignment. Chamber notches 207 are provided inside of the center chamber 202 and the inner chambers 204 to help secure insulation inside of the chamber. The block 120 has a center front cavity 209 that, for example, provides space for the placement and running of electrical cables.

Figures 2A, 2B, 2C, 2D:
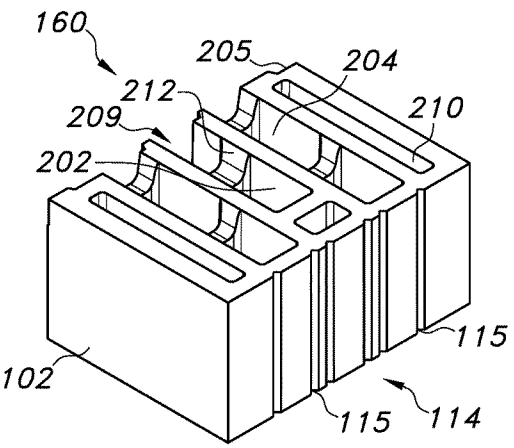
FIG. 2A is a first perspective view of an end block, showing a first wall face, the top face, and an outer end face.
FIG. 2B is a second perspective view of the end block, showing the first wall face and the inner end face.
FIG. 2C is a third perspective view of the end block, showing the outer end face and the bottom face.
FIG. 2D is a fourth perspective view of the end block, showing the bottom face and the inner end face.
Figure 2E:
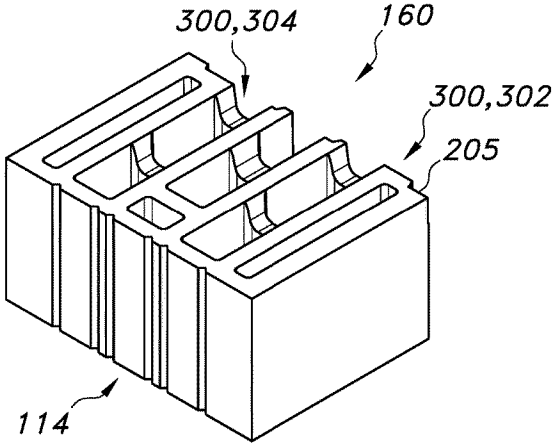
FIG. 2E is a fifth perspective view of the top plan view of the end block, showing the top face, the inner end face and the second wall face.
Figure 2H:
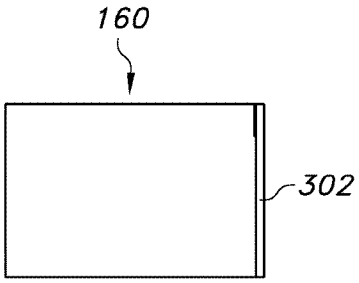
FIG. 2H is a planar view of a wall face of the end block.
Figure 2F:
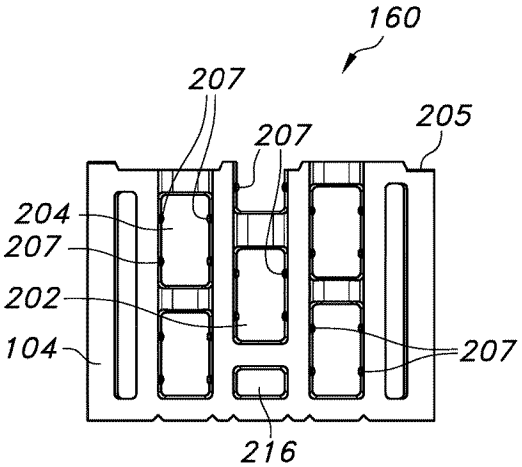
FIG. 2F is a planar view of the end block, showing the top face.
Figure 2G:
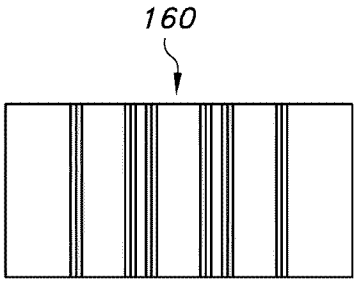
FIG. 2G is a planar view of the end block, showing the inner end face.

FIGS. 2A-2E are perspective views of the end block 160, which has the two wall faces 102 and the second end face 106 described above in connection with the stretcher block 120, but the first end face is a solid outer end face 114 with a number of grooves 115. FIGS. 2F-2H are planar views of the end block. A comparison of the end block 160 with the stretcher block 120 reveals that the end block 160 is very similar in construction to the stretcher block, but that the first end face 104 with the male connector 302 and female connector 304 has been replaced by the outer end face 114. This end block 160 is used to finish off the end of a wall, as shown in FIG. 5.

Figure 3B:
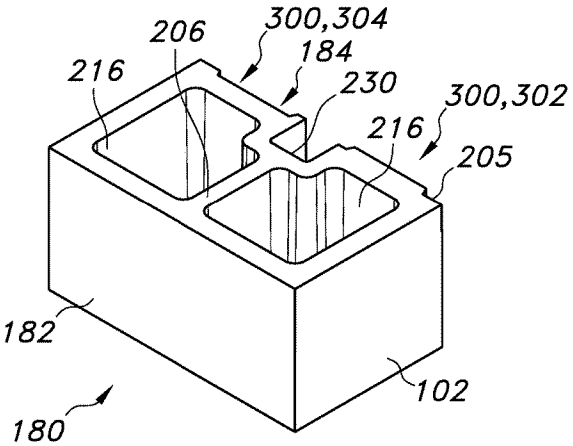
FIG. 3B is a second perspective view of the corner block, showing the top face, the second wall face, and an inner end face.
Figure 3D:
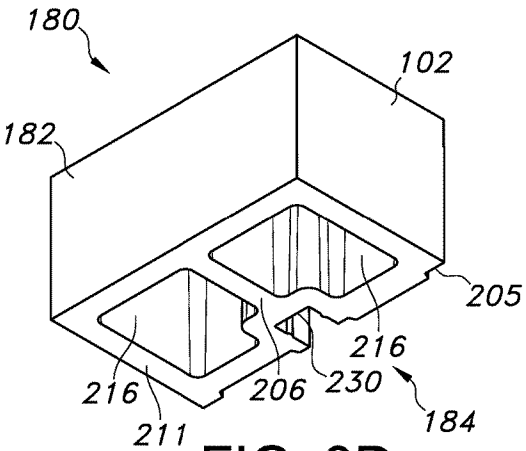
FIG. 3D is a fourth perspective view of the corner block, showing the bottom face, the first wall face, and the inner end face.
Figure 3A:
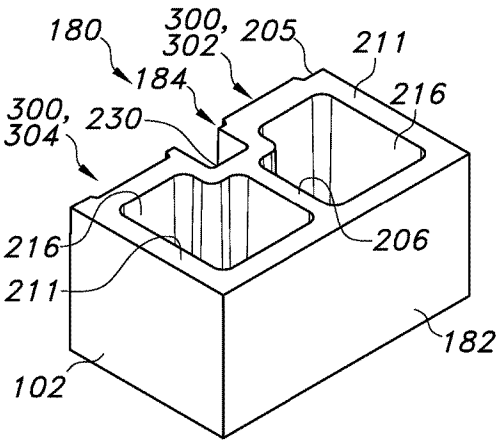
FIG. 3A is a first perspective view of a corner block, showing a first wall face, a top face, and an outer end face
Figure 3C:
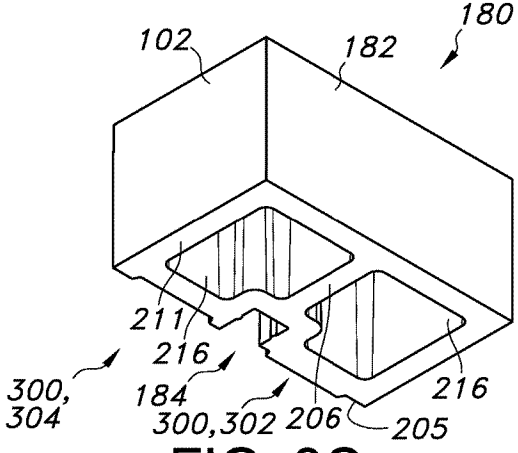
FIG. 3C is a third perspective view of the corner block, showing the bottom face and the outer end face.
Figure 3E:
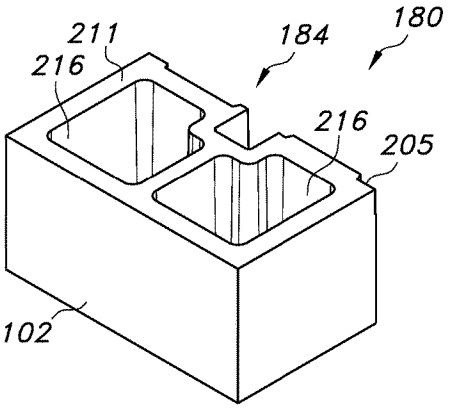
FIG. 3E a fifth perspective view of the corner block, showing the second wall face, the top face, and the inner end face.
Figure 3H:
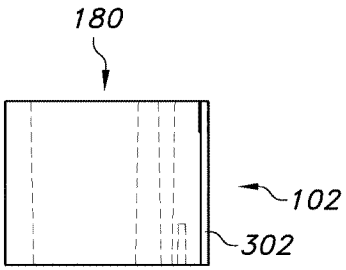
FIG. 3H is a planar view of a wall face of the corner block.
Figure 3F:
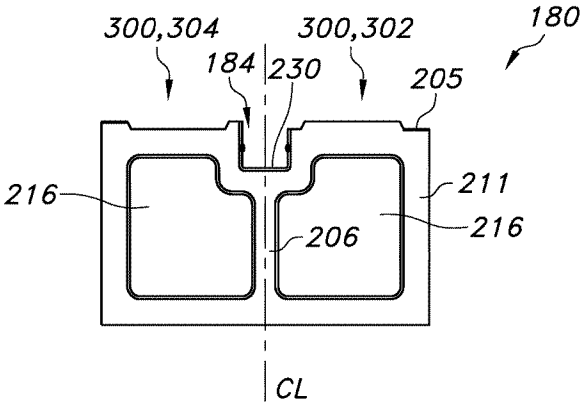
FIG. 3F is a planar view of the corner block, showing the top face.
Figure 3G:
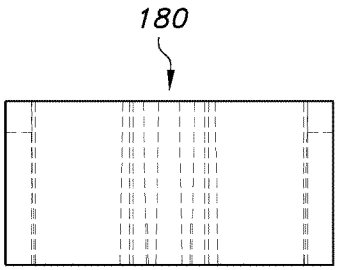
FIG. 3G is a planar view of the corner block, showing the inner end face.
Figure 5:
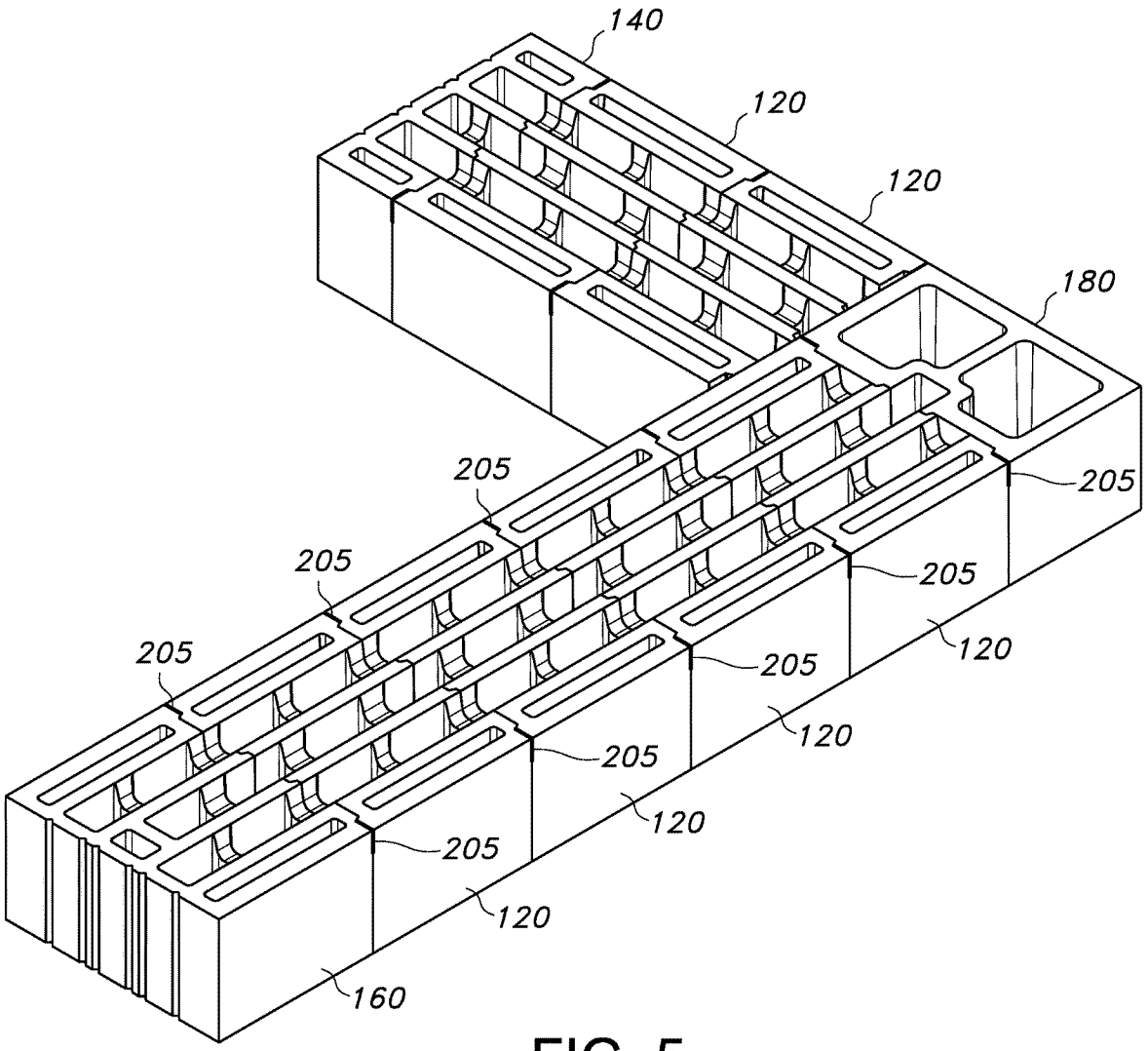
FIG. 5 is a top plan view of a wall constructed of the building block system according to the invention.

FIGS. 3A-3E are perspective views and FIGS. 3F-3G planar views of the corner block 180, which is used to form a corner in a wall, as shown in FIG. 5. The corner block 180 has the wall faces 102, a first end face that is now a solid wall 182, and a second end face 184 that includes the male connector 302 and the female connector 304 with the recesses 230. Arranged symmetrically about the centerline $C_L$ are two large chambers 216 that are bounded by the outer webs 211, a center web 206, and the second end face 184. As with the chambers in the other blocks, the large chambers 218 are open passageways through the block 180.

Figure 4B:
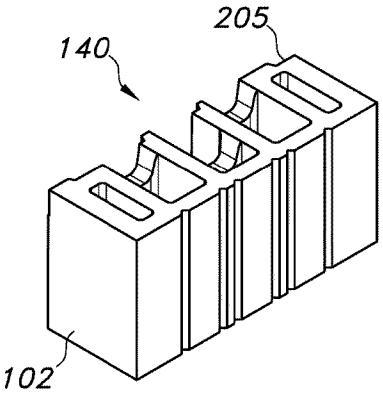
FIG. 4B is a second perspective view of the half block, showing a second wall face, the top face, and the inner end face.
Figure 4D:
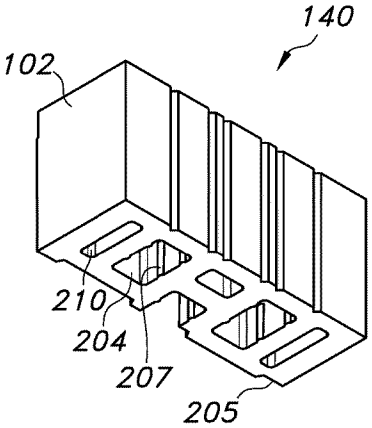
FIG. 4D is a fourth perspective view of the half block, showing the bottom face, the second wall face, and the inner end face.
Figure 4A:
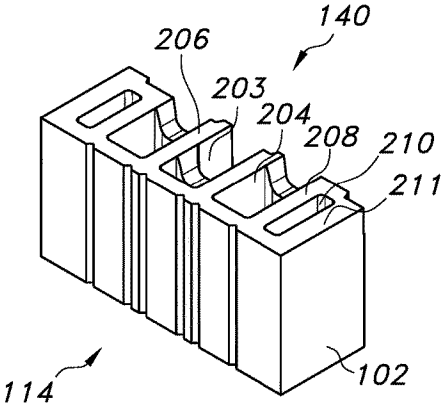
FIG. 4A is a first perspective view of a half block, showing a first wall face, an outer end face and a top face.
Figure 4C:
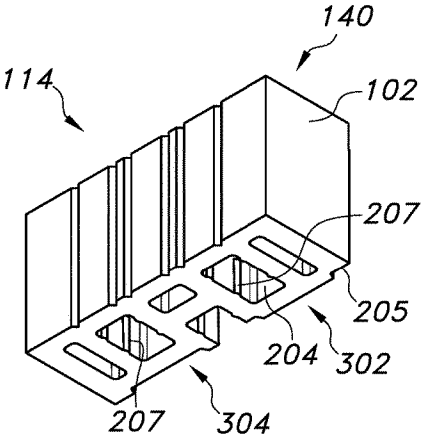
FIG. 4C is a third perspective view of the half block, showing the bottom face, the outer end face and the first wall face.
Figure 4E:
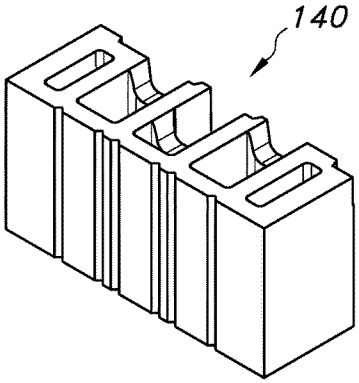
FIG. 4E is a fifth perspective view of the half block, showing the second wall face and the inner end face.
Figure 4F:
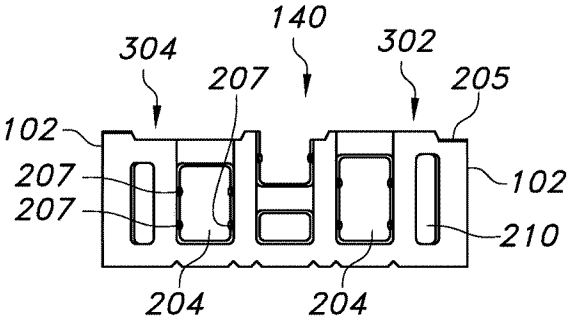
FIG. 4F is a planar view of the half block, showing the top face.
Figure 4H:
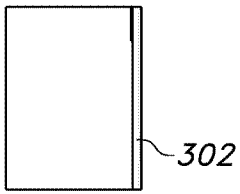
FIG. 4H is a planar view of the half block, showing a wall face.
Figure 4G:
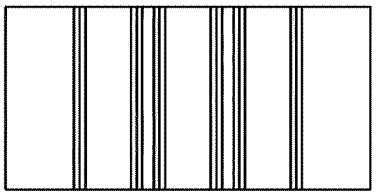
FIG. 4G is a planar view of the half block, showing the inner end face.

FIGS. 4A-4F are perspective views and FIGS. 4G-4H planar view of the half block 140. This block is used as an end block, in place of the full-size end block 160, so that the blocks 100 may be laid on bond relative to the previously laid course of blocks 100. In other words, the half block 140 and the end block 160 are used in alternating rows at the corner, to that the joint formed by the end faces of two adjacent blocks will be over the approximate center of the block 100 in the course just below. See the half block 140 in FIG. 5. The construction of this half block 140 is very similar to that of the end block 160, in that it has the wall faces 102, the recesses 220 and cavities 212. The center chamber 202 is now a truncated half-block chamber 203. As with the other blocks, the chambers 203, 204, and 210 are open passages through the block 140.

FIG. 5 illustrates a course of a wall constructed with the building block 100 according to the invention. The course of wall starts with an end block 160. Stretcher blocks 120 are interconnected with each other. In the embodiment shown, the wall includes a first wall and a second wall that extends at a 90-degree angle to the first wall. At the corner, a corner block 180 is used to bring the wall to the desired length and provide a finished outer face on three sides. Stretcher blocks 120 are then laid out along the second wall. In this particular course, the second wall is finished off with a half block 140.

Figure 6B:
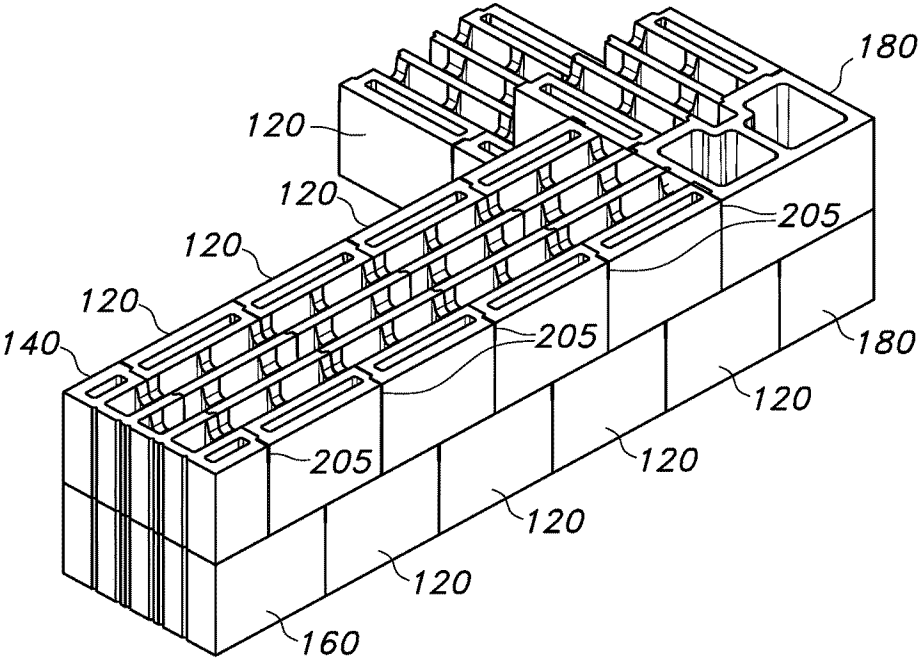
FIG. 6B is a perspective view of two course of block laid on bond.
Figure 6A:
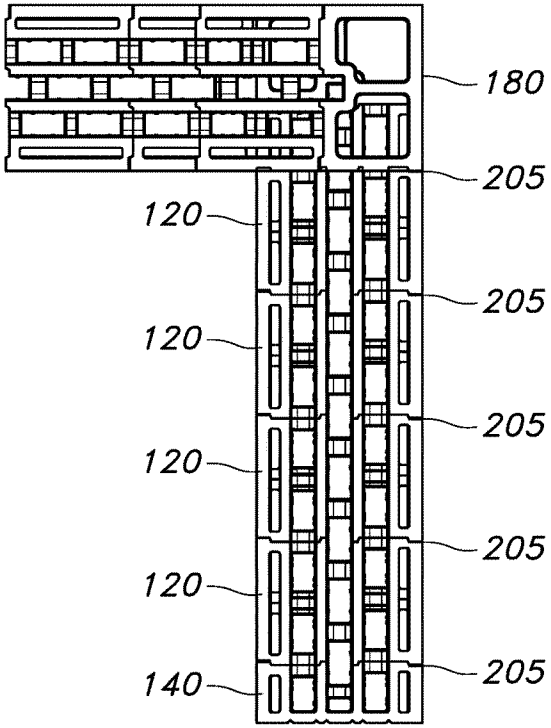
FIG. 6A is a planar view of a wall constructed of the blocks according to the invention.

FIG. 6A illustrates a wall constructed of the blocks 100. FIG. 6B illustrates two courses of blocks 100, one laid on top of the other.

Figure 7:
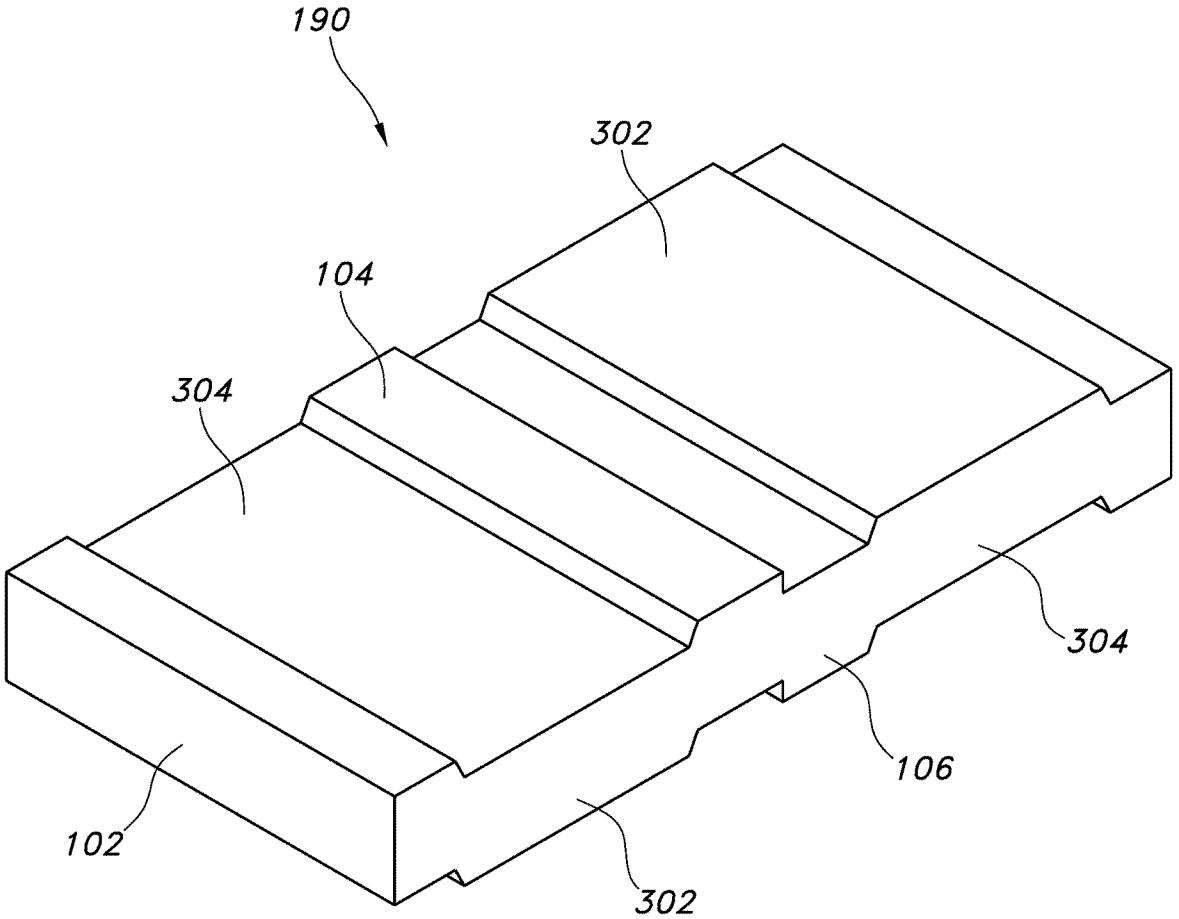
FIG. 7 is a perspective view of a spacer block.

FIG. 7 illustrates the spacer block 190 for filling any gaps or spaces that are created in the wall, particularly at or near the corners of the wall. The spacer block's 190 two end faces 104, 106, each have a male connector 302 and a female connector 304. Placing the spacer block 190 between, for example, a stretcher block 120 and a corner block 140 causes the male connector 302 on the first end face 104 of the spacer block 190 to mate with the female connector 304 on the second end face 106 of the adjacent block. Similarly, the female connector 304 of the spacer block 190 mates with the male connector 302 of the adjacent block.

The blocks 100 are made in standard sizes, but it is understood that the true size may be slightly smaller than the nominal dimension, for example, 12 inches or 10 inches, to ensure that the size of the wall is kept to specified dimensions.

It is understood that the embodiments described herein are merely illustrative of the present invention. Variations in the construction of the masonry block system may be contemplated by one skilled in the art without limiting the intended scope of the invention herein disclosed and as defined by the following claims.

What is claimed is:

1. A masonry block comprising:

a stretcher block that is substantially rectangular, the four sides of the block including two wall faces, a first end face having a male connector and female connector, a second end face having a male connector and a female connector, a top face and a bottom face, wherein the male connector is adapted to mate with the female connector of an adjacent block, and the female connector is adapted to mate with the male connector of the adjacent block, the two wall faces being the faces of the block that are visible when the wall is constructed, an upper face and a lower face of the block being open;

a plurality of chambers including a center chamber located in the center portion of the block between the male and female connectors on the end faces and bounded on the ends by a cavity wall, and four inner chambers, two inner chambers positioned on either side of the center chamber and bounded on the ends by cavity walls and within the bounds of the male and female connectors on the end faces, and the inner chambers being separated from the center chamber by center webs, and two outer chambers that are bounded by the end faces and separated from the inner chambers by inner webs and bounded on the ends by cavity walls;

wherein the cavity walls form outer recesses that align with the outer recess on an adjacent black, with the chambers and recesses forming open passages that extend through the stretcher block.

2. The masonry block of claim 1 further comprising a notch in an upper corner of each end face for receiving a line pin;

wherein, when a course of masonry blocks has been put in place and the line pin inserted in the notch of a plurality of blocks in the course, a line may be run through the line pins which, when drawn tight, forces the course of masonry blocks into a straight alignment.

3. The masonry block of claim 2 further comprising chamber notches located inside one or more of the chambers.

4. The masonry block of claim 3 further comprising a center front cavity located between the male connector and the female connector.

5. A masonry block comprising:

a end block that is substantially rectangular, the four sides of the block including two wall faces, a top face and a bottom face, a first end face having solid outer end face with a number of grooves, a second end face having a male connector and a female connector, wherein the male connector is adapted to mate with the female connector of an adjacent block and the female connector is adapted to mate with the male connector of the adjacent block, the two wall faces being the faces of the block that are visible when the wall is constructed, an upper face and a lower face of the block being open;

a plurality of chambers including a center chamber located in the center portion of the block between the male and female connectors on the end faces and bounded on the ends by a cavity wall, and four inner chambers, two inner chambers positioned on either side of the center chamber and bounded on the ends by cavity walls and within the bounds of the male and female connectors on the end faces, and the inner chambers being separated from the center chamber by center webs, and two outer chambers that are bounded by the end faces and separated from the inner chambers by inner webs and bounded on the ends by cavity walls;

wherein the cavity walls form outer recesses that align with the outer recess on the adjacent black, with the chambers and recesses forming open passages that extend through the end block.

6. The masonry block of claim 5 further comprising a notch in an upper corner of the second end face for receiving a line pin;

wherein, when a course of masonry blocks has been put in place and the line pin inserted in the notch of a plurality of blocks in the course, a line may be run through the line pins which, when drawn tight, forces the course of masonry blocks into a straight alignment.

7. The masonry block of claim 6 further comprising chamber notches located inside one or more of the chambers.

8. The masonry block of claim 7 further comprising a center cavity located between the male connector and the female connector.

* * * * *